US010975539B2

(12) United States Patent
Parsons

(10) Patent No.: US 10,975,539 B2
(45) Date of Patent: Apr. 13, 2021

(54) RAPIDLY DEPLOYABLE FLOOD DEFENCE SYSTEM

(71) Applicant: Robert John Parsons, Ottawa (CA)

(72) Inventor: Robert John Parsons, Ottawa (CA)

( * ) Notice: Subject to any disclaimer, the term of this patent is extended or adjusted under 35 U.S.C. 154(b) by 0 days.

(21) Appl. No.: 16/912,878

(22) Filed: Jun. 26, 2020

(65) Prior Publication Data

US 2020/0407932 A1 Dec. 31, 2020

Related U.S. Application Data

(60) Provisional application No. 62/866,721, filed on Jun. 26, 2019.

(51) Int. Cl.

| | |
|---|---|
| ***E02B 3/10*** | (2006.01) |
| ***E02B 7/20*** | (2006.01) |
| *E06B 9/00* | (2006.01) |

(52) U.S. Cl.

CPC ..... *E02B 3/108* (2013.01); *E02B 7/20* (2013.01); *E06B 2009/007* (2013.01)

(58) Field of Classification Search

CPC ..... E02B 3/108; E02B 7/20; E06B 2009/007
USPC ..... 405/15, 16, 21, 107, 110, 111, 114, 115, 405/116

See application file for complete search history.

(56) References Cited

U.S. PATENT DOCUMENTS 3,465,530 A * 9/1969 Renfro ..... E02B 3/102 405/110
4,252,461 A * 2/1981 Colamussi ..... E02B 7/005 405/115
4,299,514 A * 11/1981 Muramatsu ..... E02B 7/005 405/107
4,729,691 A * 3/1988 Sample ..... E02B 3/06 405/21
4,966,491 A * 10/1990 Sample ..... E02B 3/04 405/19

(Continued)

FOREIGN PATENT DOCUMENTS

| | | |
|---|---|---|
| CA | 2909346 A1 | 10/2014 |
| CA | 2974437 A1 | 3/2018 |
| EP | 0586364 A1 | 3/1994 |

OTHER PUBLICATIONS

GB Search Report dated Oct. 1, 2020 from corresponding Application No. GB 2009792.9, 1 page.

(Continued)

*Primary Examiner* — Edwin J Toledo-Duran

(57) ABSTRACT

The present invention is a rapidly deployable flood defense system and method that has at least one barrier cover, each comprising a plurality of laterally-extending crossbeam housing tubes stacked generally vertically and housing an inflatable crossbeam disposed within the tube, an end retaining tab at each end of the tube, and a plurality of rear support retaining tabs spaced along the lateral length of the crossbeam housing tube; and a front apron and a rear apron. The system also has a plurality of support tubes and a plurality of additional support tubes positioned along the lateral length of the crossbeam housing tube. Each support tube held in the generally vertical direction by a base post and each and additional support tube positioned along the lateral length of the crossbeam housing tube having an additional base post positioned rearwardly.

18 Claims, 8 Drawing Sheets

(56) References Cited

U.S. PATENT DOCUMENTS 5,059,065 A * 10/1991 Doolaege ..... E02B 3/127 405/115
5,421,128 A 6/1995 Sharpless et al.
5,645,373 A * 7/1997 Jenkins ..... E02B 3/108 405/114
5,677,023 A 10/1997 Brown
5,735,083 A 4/1998 Brown et al.
5,971,661 A * 10/1999 Johnson ..... E02B 3/108 405/114
5,993,113 A * 11/1999 Darling ..... E02B 3/108 405/114
6,029,405 A * 2/2000 Wood ..... E04H 3/14 52/2.23
6,450,733 B1 * 9/2002 Krill ..... E02B 3/102 405/114
6,641,329 B1 * 11/2003 Clement ..... E02B 3/108 405/115
7,690,865 B1 * 4/2010 Stewart ..... E02B 3/108 405/115
9,528,236 B2 * 12/2016 Vickers ..... E02B 3/10
9,708,786 B2 7/2017 James
9,719,225 B2 * 8/2017 Abeles ..... E02B 7/005
10,036,134 B2 * 7/2018 Abeles ..... E02B 3/108
10,174,474 B2 * 1/2019 Hamada ..... E02B 3/062
2002/0110424 A1 8/2002 Page
2003/0190193 A1 * 10/2003 Waters, Jr. ..... E02B 7/54 405/110
2005/0169712 A1 * 8/2005 Young ..... E02B 3/108 405/116
2007/0243021 A1 10/2007 Tyler
2008/0253838 A1 10/2008 Salemie
2010/0003081 A1 * 1/2010 Doolaege ..... E02B 3/108 405/115
2011/0318104 A1 * 12/2011 Peterson ..... E02B 3/108 405/16
2013/0219802 A1 8/2013 Willis et al.
2015/0125213 A1 * 5/2015 Abeles ..... E02B 7/005 405/111
2017/0101758 A1 * 4/2017 Abeles ..... E02B 3/127
2017/0284046 A1 * 10/2017 Abeles ..... E02B 3/108
2019/0024337 A1 * 1/2019 Philipsen ..... E02B 3/108
2020/0208371 A1 * 7/2020 Angeloff ..... E02D 19/04

OTHER PUBLICATIONS

Extended EP Search Report dated Oct. 23, 2020 from corresponding Application No. EP 20182673, 7 pages.

* cited by examiner

Figure 1 - Barrier Cover - Front View Isometric

Figure 2 – Barrier Cover - Side View

Figure 3 – Barrier Cover - Plan View

© 2019 R J Parsons

Figure 5 – Deployed Barrier - Rear Isometric View

Figure 6 – Flood Barrier connection

Figure 7 – Deployed Barrier – Plan View

RAPIDLY DEPLOYABLE FLOOD DEFENCE SYSTEM

CROSS REFERENCE TO RELATED APPLICATION

This application claims priority under 35 USC § 119 to U.S. Provisional Patent Application No. 62/886,721 filed on Jun. 26, 2019, the contents of which are hereby incorporated by reference in its entirety.

FIELD OF THE INVENTION

This present invention relates to a rapidly deployable flood barrier or diking system that, when used in combination with the staking system, may be quickly and easily positioned and inflated to provide a durable barrier to provide environmental remediation and contain rivers, lakes and other bodies of water reaching flood stage.

BACKGROUND OF THE INVENTION

The use of sand filled burlap bags has been the conventional means of containing flooding rivers for several centuries. Burlap-type sandbags suffer the disadvantage that they need to be first filled with sand, then sealed individually and conveyed to the site of a flood, resulting in enormous labour and logistic costs, and requiring thousands of person hours to deploy and stack the sandbags in place. Once used and the flood waters have receded, the burlap sandbags need to be removed or they tend to rot or split. Often, the sandbags are contaminated by sewage and other toxic waste that is extremely hazardous to humans and animals, and require extensive decontamination or special disposal arrangements. Removal of the sandbags results in the same costs and resource requirements as the initial deployment.

In an attempt to overcome the disadvantages associated with burlap-type sandbags, various individuals have proposed the use of temporary flood barriers formed as water inflatable or water actuated temporary walls, such as those sold by AquaDam Inc. of Scotia, Calif. and that disclosed in Canadian Patent No. CA 2,974,437 to P.V. Flood Control Corp., issued on 2018 Mar. 6. The cylindrical tubes are positioned along the edge of a flooding river, and filled with water to form a temporary barrier. Water filled cylindrical tube flood barriers, however, suffer various disadvantages of instability and often require extensive and costly decontamination after being collapsed for withdrawal and storage.

One type of currently used inflatable barriers filled with air, such as that disclosed in Canadian Patent Number CA 2,909,346 issued to Cintec International Ltd of the United Kingdom, are monolithic in design, particularly with respect to the barrier component and may be susceptible to catastrophic failure in the event that the barrier component becomes damaged.

The prior art cylindrical tubes suffer a further disadvantage in that the tubes are prone to rupture, not only from internal pressures, but also from puncture and tearing by logs and other debris swept along by the flood waters, and which may strike against the side of the inflated tube.

SUMMARY OF THE INVENTION

The present invention seeks to overcome the disadvantages of prior art flood barriers by providing a portable flood barrier which may be rapidly and easily deployed, and which may be collapsed and stored for reuse, without the need for extensive resources, site preparation or large storage and handling facilities.

The present invention provides an elongated and collapsible flood barrier which may be readily deployed adjacent a flooding riverbank, lake or other water body which is approaching flood stage, and then inflated with air to form a temporary barrier.

The flood barrier is formed as a water impermeable cover, containing one or more removable inflatable tubes or crossbeams which are elongated in a longitudinal direction and sealed at each of its ends. One or more drain and/or fill holes are formed into the tube, to permit the air to be pumped into and drained from the tube interior to inflate and deflate the flood barrier. The flood barrier also includes a means of joining other barriers to each other to form a continuous flood containment system.

The present invention provides a rapidly deployable flood defense system, comprising: at least one barrier cover, each comprising: a plurality of laterally-extending crossbeam housing tubes being stacked in a generally vertical direction, each crossbeam housing tube comprises: an inflatable crossbeam disposed within the crossbeam housing tube, an end retaining tab at each end of the crossbeam housing tube, and a plurality of rear support retaining tabs spaced along the lateral length of the crossbeam housing tube, where each of the rear support retaining tabs is generally in the same vertical plane as the rear support retaining tab on the crossbeam housing tube above or below; and a front apron and a rear apron, each at a base of the barrier cover; a plurality of support tubes extending in the generally vertical direction, with said plurality of support tubes including: one support tube placed at each end of the crossbeam housing tubes and through the plurality of end retaining tabs to hold the support tube in place, and a plurality of additional support tubes positioned along the lateral length of the crossbeam housing tube and are held in place by the plurality of rear support retaining tabs; each of the plurality of support tubes is held in the generally vertical direction by a base post which is configured to be secured to the ground; and each of the additional support tubes positioned along the lateral length of the crossbeam housing tube comprises an additional base post positioned rearwardly from the additional support tubes, and an extendable support which extends between the additional base post and the additional support tube.

In a preferred embodiment of the invention, the at least one barrier cover comprises a first barrier cover and a second barrier cover, and the one support tube placed through the plurality of end retaining tabs at one end of the first barrier cover is also placed through the plurality of end retaining tabs at one end of the second barrier cover forming a barrier cover connection.

Preferably, this would also include a laterally-extending side cover panel at the end of the first barrier cover, covering the barrier cover connection.

In a preferred embodiment of the invention, there are securing clamps securing each of the plurality of extendable supports to one of the plurality of support tubes and/or securing clamps securing each of the plurality of rear support retaining tabs to each of the plurality of support tubes.

The present invention also discloses a method of deploying a flood defense system, comprising the steps of: a) orienting a barrier cover laterally parallel to a bank of a flooding river, the barrier cover comprising a plurality of laterally-extending crossbeam housing tubes stacked in a generally vertical direction, with each crossbeam housing tube comprising an uninflated inflatable crossbeam disposed therein, an end retaining tab at each end of the crossbeam housing tube and a plurality of rear support retaining tabs spaced along the lateral length of the crossbeam housing tube, where each of the rear support retaining tabs is generally in the same vertical plane as the rear support retaining tab on the crossbeam housing tube above or below; b) securing a base post to the ground at the position of each of the end retaining tabs and each of the plurality of rear support retaining tabs; c) placing a support tube at each end of the crossbeam housing tube and at each of the plurality of rear support retaining tabs; d) inserting each of the support tubes located at each end of the crossbeam housing tube through the end retaining tabs and on the base post in the generally vertical direction; e) inserting each of the support tubes located at each of the plurality of rear support retaining tabs through the end retaining tabs and on the base post in the generally vertical direction; f) for each of the support tubes located at each of the plurality of rear support retaining tabs, secure an additional base post in a rearward direction; g) inflate the inflatable crossbeams; and h) extend an extendable support between each of the additional base posts and the corresponding support tube located at each of the plurality of rear support retaining tabs.

Preferably, the method also comprises the step of deploying a second barrier cover laterally adjacent to the barrier cover, where during step d), when the support tube is inserted at one end of the crossbeam housing tube through the end retaining tabs of the barrier cover, the support tube is also inserted through the end retaining tabs of the second barrier cover, forming a barrier cover connection.

In a preferred embodiment, the invention includes the additional step of covering the barrier cover connection with a side cover panel which extends laterally from the barrier cover.

In another preferred embodiment, the invention includes the additional step of securing each of the extendable supports to each of the corresponding support tubes with a securing clamp.

In a preferred embodiment, the invention includes additional step of securing each of the plurality of rear support retaining tabs to each of the plurality of support tubes with a securing clamp.

In another preferred embodiment, the invention includes the additional steps of: extending a front apron and a rear apron from the barrier cover, and securing the front and rear aprons to the ground with sand bags or tent pegs.

DETAILED DESCRIPTION OF THE PREFERRED EMBODIMENT

Figure 1:
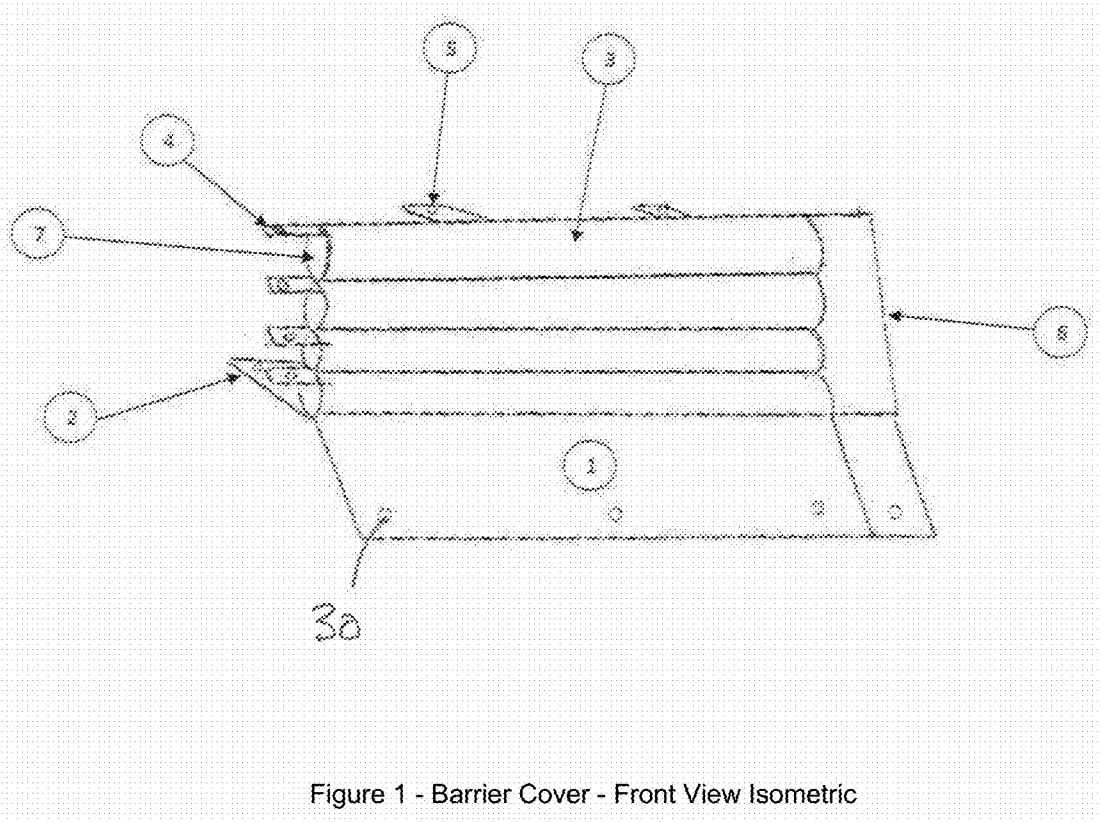
FIG. 1 shows the front view of the barrier cover of the present invention.
Figure 2:
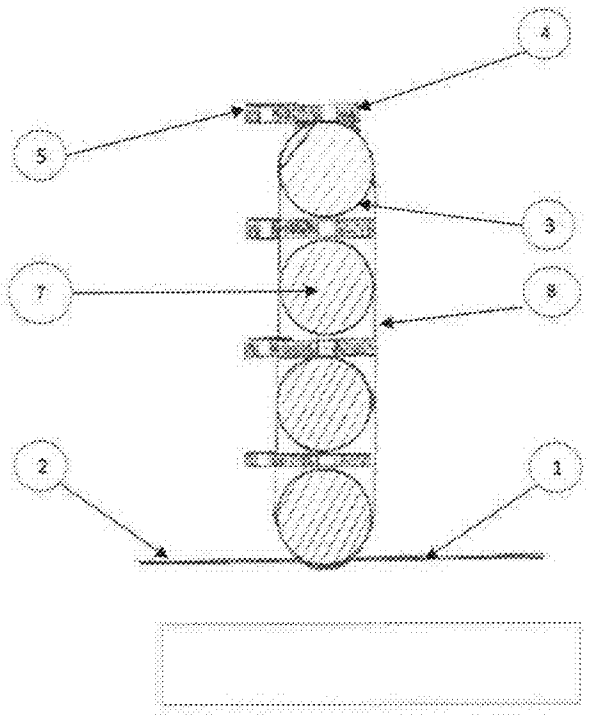
FIG. 2 shows the side view of the barrier cover of the present invention.

The rapidly deployable flood-defense system 11 comprises a barrier cover 8, as shown in FIGS. 1-4. The barrier cover 8 comprises a front apron 1, a rear apron 2, and a plurality of crossbeam housing tubes 3 for containment of the air inflatable crossbeams 7. The crossbeam housing tubes 3 are laterally-extending and stacked in a vertical direction.

As can be seen in the Figures, each crossbeam housing tube 3 includes an end retaining tab 4 at each end, and a plurality of rear support retaining tabs 5 which are spaced along the lateral length of each crossbeam housing tube 3. As can be seen especially in FIGS. 2 and 4, the rear support retaining tabs 5 of each crossbeam housing tube 3, are spaced apart identically to the rear support retaining tabs of the crossbeam housing above and below. This way, all of the rear support retaining tabs 5 line up in a generally vertical direction.

The barrier cover 8 is a textile component that is used to provide the overall structure and shape of the flood barrier 11. It also provides additional protection for the inflatable crossbeams 7, a means of holding the crossbeams 7 within the crossbeam housing tubes 3, a means of joining several flood barriers 11 together and a means of preventing seepage of water between the crossbeams 7.

The barrier cover 8 comprises a front and back cover that are either a single piece of fabric or several pieces that are bonded together, preferably using RF welds. Inside the cover are a plurality of crossbeam housing tubes 3 that hold the inflatable crossbeams 7 in place.

The barrier cover 8 is made from a flexible material preferably extruded polyvinyl chloride (PVC) that is approximately 0.5 to 2 mm thick, preferably 1 to 1.5 mm thick. The crossbeam housing tubes 3 are made of the same material and are each of a diameter that will each comfortably and securely house the air inflatable crossbeam 7. Preferably, each crossbeam housing tube 3 is bonded to the tube 3 above it, more preferably using RF welding, to give the desired height. The resultant structure will generally be as shown in FIGS. 1-4.

The barrier cover 8 includes one or more air inflatable crossbeams 7 which are sealed along each of the longitudinal edges and are generally circular in shape. Each crossbeam 7 is formed from a flexible material such as a 0.5 to 1 mm thick extruded polyvinyl chloride (PVC) that can be inflated to a low air pressure of between 1 and 20 psi, more preferably between 2 and 12 psi, or a combined PVC coated woven fiber reinforcing cloth to enable it to be inflated to high air pressures between 20 and 70 psi, or more preferably between 40 and 60 psi. The crossbeams 7 are similar in nature to the Airbeams™ manufactured by HDT Global Inc and covered under US patents numbers:

U.S. Pat. No. 5,421,128 Curved, Inflated, Tubular Beam
U.S. Pat. No. 5,677,023 Reinforced Fabric Inflatable Tube
U.S. Pat. No. 5,735,083 Braided Airbeam Structure The crossbeams 7 are sealed at both ends and have a valve mechanism to allow inflation and deflation. Preferably, a meter is installed to allow crossbeam 7 air pressure to be monitored.

The crossbeams 7 can be either low-pressure inflatable beams made from PVC or similar fabric, or high-pressure inflatable beams made from specially treated PVC or similar fabric. In general, high pressure crossbeams 7 are used where there is flowing water that may contain debris and other materials that could puncture the crossbeam 7. For containment of lakes, ponds and slow or non-flowing water, a low-pressure crossbeam is suitable. The crossbeams 7 are inserted into crossbeam housing tubes 3 within the barrier cover 8 and then fully inflated to provide the strength, rigidity and height of the flood barrier 11.

Figure 6:
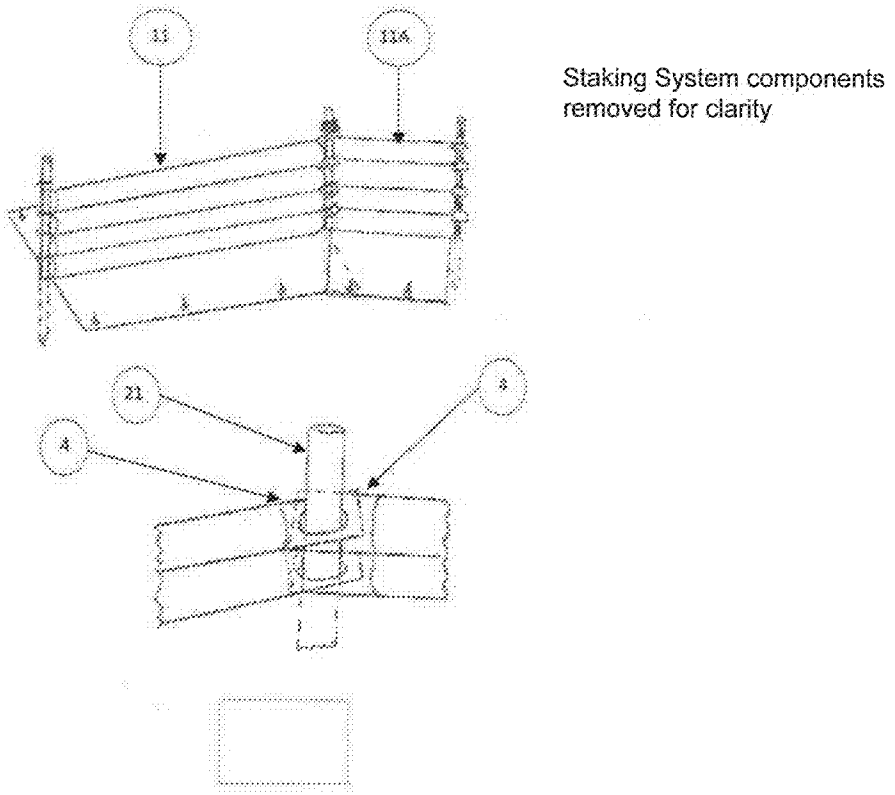
FIG. 6 shows how the barrier covers are connected together longitudinally.
Figure 7:
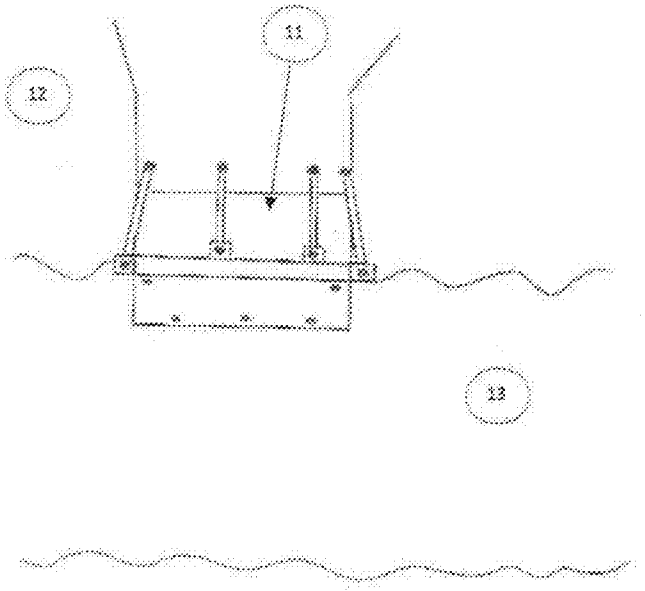
FIG. 7 shows a top view of the deployed flood defense system of the present invention.

The barrier covers 8 can vary in length and height, and with that, the inflatable crossbeams 7 can also vary in size, length, and number used in each barrier cover 8. Each inflatable crossbeam 7 has a preferred overall length selected at between about 1 and 100 metres, preferably between about 1 to 10 metres, and most preferably between about 1 and 7 metres. Crossbeams 7 used in a smaller barrier 11A (as seen in FIG. 6) have an overall length selected at between about 0.5 and 1.5 metres, preferably between about 0.8 to 1.3 metres, and most preferably between about 0.9 and 1.2 metres.

The front and rear aprons 1 and 2 are designed to provide adhesion and sealing between the bottom portion of the barrier cover 8 and the ground 12.

The front apron 1 runs along the bottom of front wall of the barrier cover 8 and extends outwards in a perpendicular direction towards the flood water. The front apron runs continuously from one edge of the barrier cover 8 to the other end. It extends outwards, as described, for between 0.3 and 1.5 metres from the base of the barrier cover 8, preferably for between 0.6 and 1.25 metres. Grommets 30 are situated at the outermost forward edge of the front apron 1 and are spaced equally along the forward edge of the front apron 1. Between two and ten grommets 30 are used to secure the front apron 1, using standard tent pegs or stakes, preferably between two and six grommets 30 are used.

The rear apron 2 runs along the bottom of front wall of the tube securing cover and extends outwards in a perpendicular direction away from the flood water. The rear apron 2 runs continuously from one edge of the tube securing cover 3A to the other end. It extends outwards, as described, for between 0.3 and 1.5 metres from the base of the tube securing cover 3A, preferably for between 0.6 and 1.25 metres. Grommets 30 are situated at the outermost forward edge of the rear apron 2 and are spaced equally along the forward edge of the rear apron 2. Between two and ten grommets 30 are used to secure the rear apron 2, using standard tent pegs or stakes, preferably between two and six grommets 30 are used.

The aprons are bonded to the barrier cover 8, preferably with RF welds. In the case of the front apron 1, the increasing weight of the flood water provides the pressure needed to ensure that the apron follows the natural contours of the ground on which it rests.

In lieu of, or in addition to, using tent pegs or stakes to secure the front and rear aprons 1 and 2 to the ground, heavy weights may be used by placing them on top of the front and rear aprons 1 and 2 butted up to the bottom of the barrier cover 8.

Figure 3:
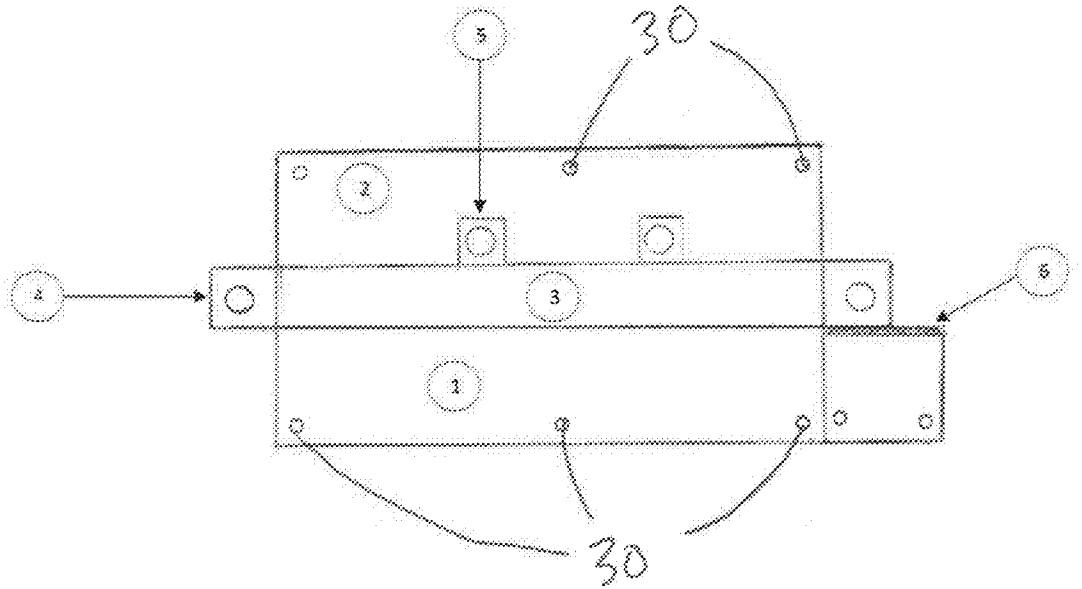
FIG. 3 shows the top view of the barrier cover of the present invention.

Additionally, and optionally, the barrier cover 8 may include a side cover panel 6, as can be seen in FIGS. 1 and 3. The purpose of this side cover panel 6 is to cover any gap formed by joining two barriers together as shown in FIG. 6 and/or to provide a means of sealing any gaps when the barrier is adjoined to a permanent structure such as a building. This is to reduce floodwater seepage.

Each side cover panel 6 extends laterally outwards from one or both ends of the barrier cover 8 for between 1-4 feet, preferably for between 1 and 3 feet. Each side cover panel 6 extends laterally outwards from the barrier cover 8 for the entire height of the barrier cover 8, from the topmost edge of the barrier cover 8, all the way to the bottommost edge of the front apron 1. This can be best seen in FIG. 1.

Each side cover panel 6 is bonded to the uppermost point of the tube securing cover 3A, preferably using RF welds. They are further bonded to the front wall of the tube securing cover 3A by a bond that extends downwards along the entirety of the front wall. They are further bonded to the bottom of the tube securing cover 3A, with a bond that runs from the bottommost inner edge of the tube securing cover outwards to the outer edge of the tube securing cover 3A. The bonds are preferably RF welds.

At each end of each crossbeam housing tube 3 is an end retaining tab 4. These end retaining tabs 4 are designed to hold a support tube 21 in place. The end retaining tabs 4 are of a sufficient diameter to hold the support tube 21 firmly in place but allowing for expansion/contraction due to outside temperature. Each end retaining tab 4 is bonded to the top of a crossbeam housing tube 3, preferably using RF welding. One option (not shown) is that each end retaining tab 4 runs the entire longitudinal length of the crossbeam housing tube 3.

As can be seen in FIG. 6, a single support tube 21 can fit inside the end retaining tabs 4 of two adjacent barrier covers 8, thus forming a barrier cover connection, and increasing the stability of the structure. As stated above, the side cover panel 6 would then fit over top of this connection, and the pressure of the flooding water would provide a seal.

Figure 4:
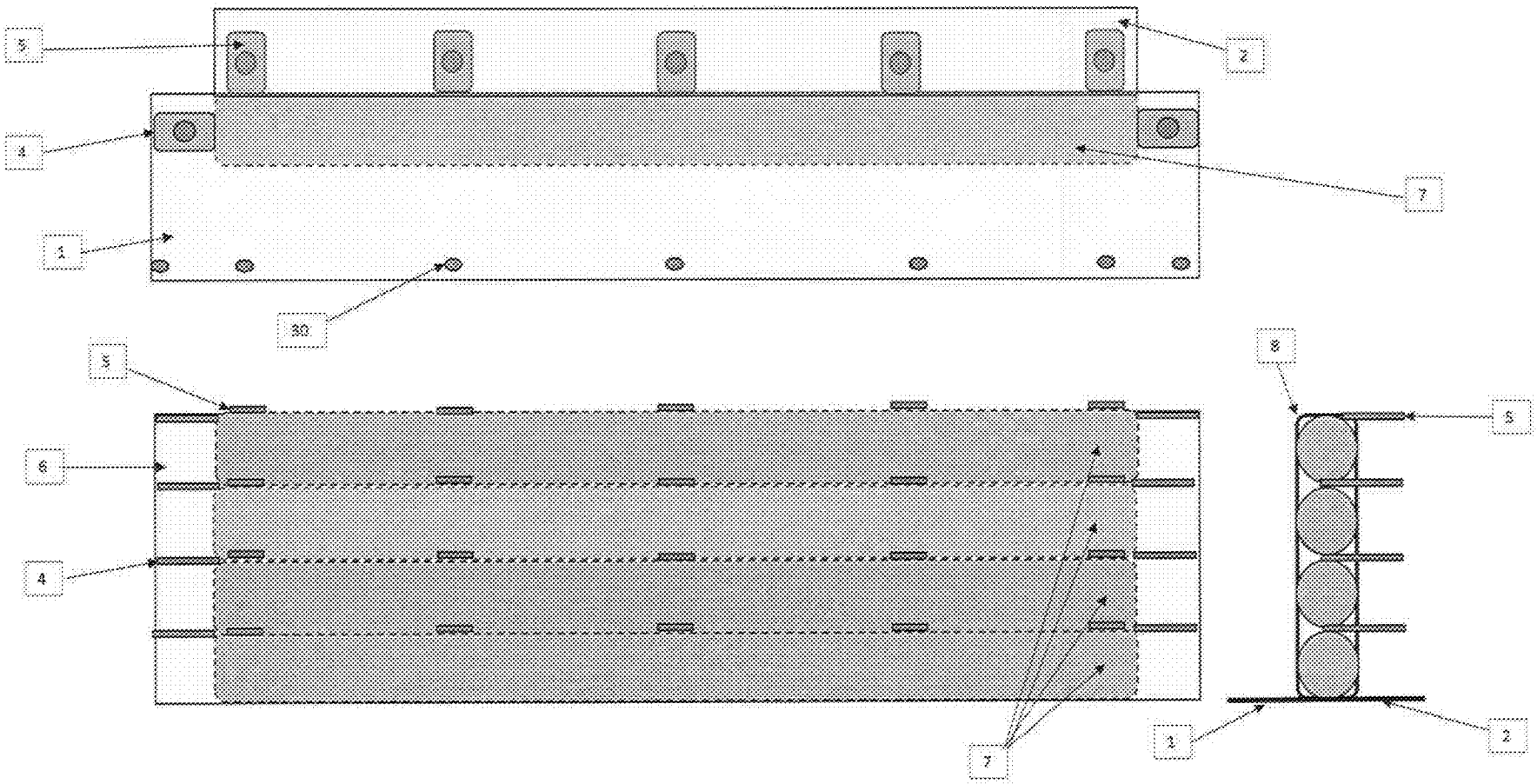
FIG. 4 shows a top, rear and side view of an alternately-sized barrier cover of the present invention.

The rear support retaining tabs 5 can be spaced at varying distances along each crossbeam housing tube 3. Shown in FIGS. 1 and 3 is an embodiment with two rear support retaining tabs along each crossbeam housing tube 3. FIG. 4 shows an embodiment having a longer crossbeam housing tube 3, with five rear support retaining tabs 5. The rear support retaining tabs 5 are preferably spaced at apart at equal distances along the lateral length of each crossbeam housing tube 3, although it is not essential to do so.

These support tube securing panels 5 are designed to hold the support tubes 21 in place against the barrier cover. They are bonded to the top of each crossbeam housing tube 3 and extend outwards, perpendicular to the crossbeam housing tube 3. They are situated one above another so that the holes on each of the rear support retaining tabs 5 are aligned in the vertical plane.

Figure 5:
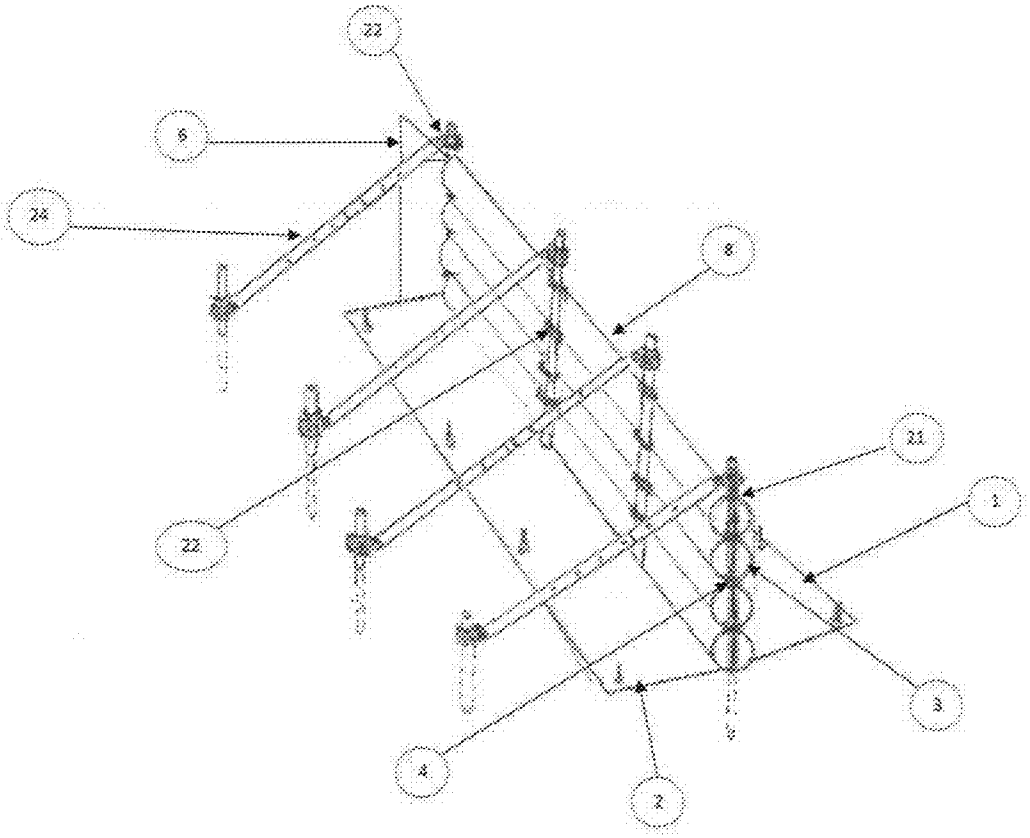
FIG. 5 shows a rear perspective view of the deployed flood defense system of the present invention.
Figure 8:
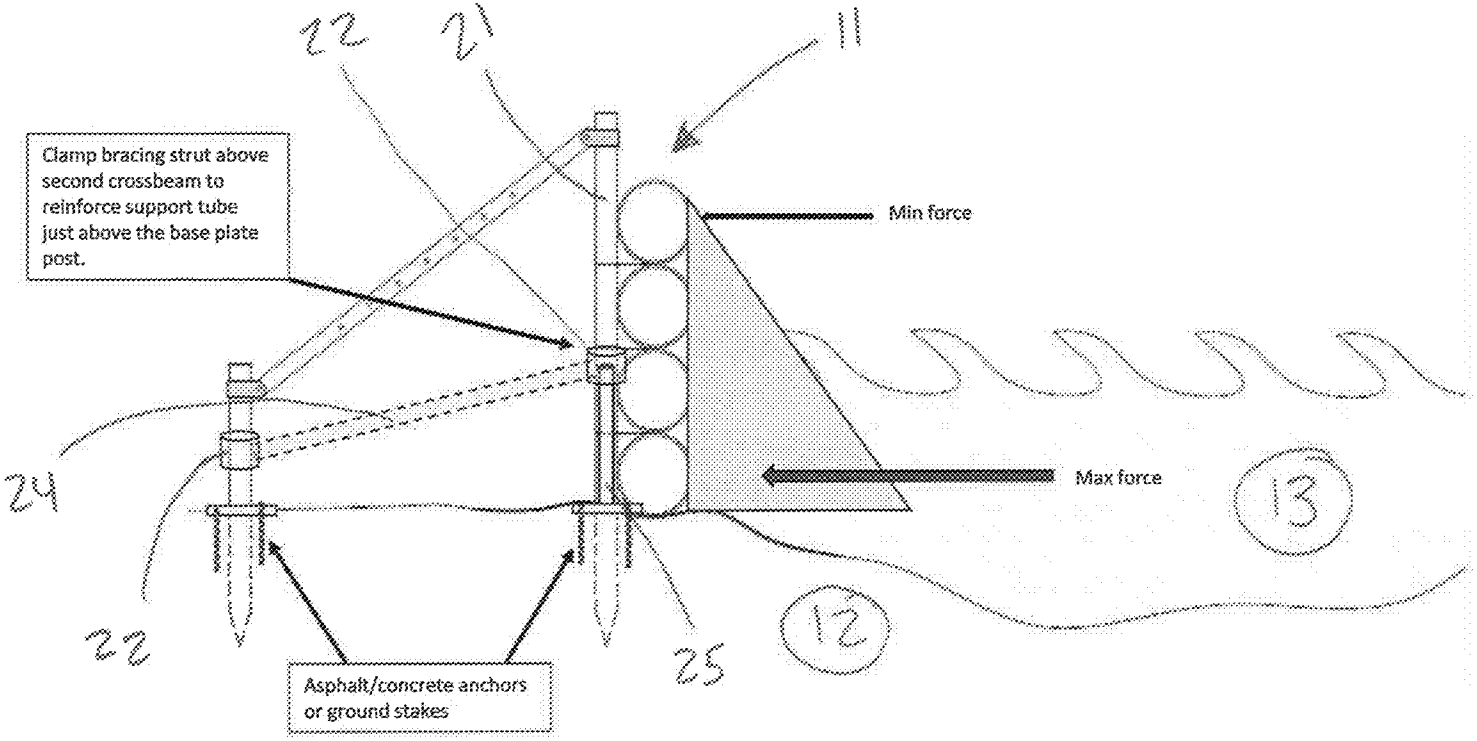
FIG. 8 shows a side view of the deployed flood defense system of the present invention.

The staking system is best seen in FIGS. 5 and 8, and is designed to provide a means of supporting the barrier cover 8 and providing the means by which the pressure of the flood water 13 against the flood barrier 11 is resisted.

The staking system comprises a support tube 21, which is between 1 m and 2 m in length, preferably between 1.2 m and 1.9 m in length and most preferably between 1.4 m and 1.7 m in length. It is made from aluminum alloy, preferably conforming to the specifications of 6061 or 7075 aluminum alloy. A composite material providing the same or better material characteristics as 6061 or 7075 aluminum alloy may also be used.

These support tubes 21 are hollow and dimensioned to fit on top of base post 25, as seen in FIG. 8. Each base post 25 is secured to the ground 12 by asphalt/concrete anchors or ground stakes, located in the same vertical plane as a column of rear support retaining tabs 5. Thus, at each position along the length of the barrier cover 8, the base post 25 is secured to the ground, the support tube 21 extends upwards from the base post 25, and the rear support retaining tabs encircle the support tube 21.

This same engagement occurs at the location of each end retaining tab 4. A base plate 25 is secured to the ground at a position at each end of the barrier cover 8, a support tube 21 extends upwards from the base post 25, and the end retaining tabs 4 of the barrier cover 8 encircle the support tube 21. In the situation where there are two adjacent barrier covers 8, a single base plate 25 and support tube 21 can support the end retaining tabs 4 of both barrier covers 8.

Preferably, an additional base plate 25 is located in a position rearwardly of the position of each combination of base post 25/support tube 21/rear support retaining tabs 5, as can be seen in FIG. 8. As can be seen, an extendable support 24 extends from the additional base plate 25 to the generally vertical support tube 21.

It should be noted that the base plate 25 and the additional base plate 25 are of exactly the same configuration. They are simply located in different locations, with the base plate being located at the base of the barrier cover 8 and supporting a support tube 21, and the additional base plate being located rearwardly of the barrier cover 8 and the support tube 21, and engaging the extendable support 24.

In an alternate embodiment, FIG. 5 shows a configuration using a simple stake at the rearward location, and holding the extendable support 24.

The extendable support 24 is designed to provide lateral support to the barrier cover 8 and fits between the support tube 21 and the rear additional base plate 25. It is made from aluminum alloy, preferably conforming to the specifications of 6061 or 7075 aluminum alloy. A composite material providing the same or better material characteristics as 6061 or 7075 aluminum alloy may also be used. One possibility for allowing the support 24 to be extendable is that the extendable support 24 comprises two tubes, one fitting inside the other.

The extendable support 24 is secured to both the rear additional base plate 25 and the support tube 21 by securing clamps 22. These securing clamps 22 are designed to fit over the support tube 21 and to both prevent the barrier cover securing panels from moving upwards due to floodwater movement. The clamps 22 are made from rust resistant steel or a material with similar properties. They may also be made from aluminum alloy, preferably conforming to the specifications of 6061 or 7075 aluminum alloy. A composite material providing the same or better material characteristics as 6061 or 7075 aluminum alloy may also be used. Each clamp 22 will be of sufficient inside diameter to fit snugly and securely over the support tube 21.

One option is for each clamp 22 to be fitted with a threaded bolt that penetrates through the shell of the clamp 22 and can be screwed inwards in order to clamp tightly against the support tube 21. Another of the same securing clamp 22 may be secured tightly to the rear additional base post 25.

FIGS. 5 and 8 also shows differing possible locations for securing clamp 22 to be engaged on support tube 21. The extendable support 24 can engage with the support tube 21 at any point along the vertical plane, although the preferred location is shown in FIG. 8, where the securing clamp 22 engages the support tube 21 just above the top of the base post 25.

In a preferred embodiment, to provide superior support, a securing clamp would be located at each point where the end retaining tabs 4 and the rear support retaining tabs 5 engage each support tube 21.

Reference is now made to FIGS. 5-8, which show a rapidly deployable flood barrier 11 in a fully inflated configuration filled with air in accordance with a preferred embodiment of the invention. The flood barrier 11 is configured to be positioned on the ground 12 (FIG. 8) adjacent a flooding river 13 (or lake or other water body), and inflated as a temporary barrier during such time as a flood threat to infrastructure or property remains. As will be described, following use, air is emptied from the inflatable crossbeams 7 and the flood barrier 11 is collapsed for storage or transportation for use elsewhere.

The rapidly deployable flood barrier 11 is formed as one or more elongated water impermeable crossbeams, contained within a barrier cover 8 and sealed at both ends of each inflatable crossbeam 7. In its longitudinal direction, the flood barrier 11 has an overall length selected at between about 1 and 100 metres, preferably between about 1 to 10 metres, and most preferably between about 1 and 4 metres. The height and lateral width of the barrier 11 may vary, but is preferably selected at between about 0.5 and 4 metres, and most preferably about 1 to 1.85 metres. With the preferred size range, a flood barrier 11 fully inflated with air would weight approximately 1,000 lbs.

For the purposes of joining barrier covers 8 together in an end to end configuration, or for enabling barriers to be joined at different angles, or for filling gaps in non-standard track/road/path/embankment openings, a smaller barrier 11A comprising a barrier cover 8 and all of the staking system components may be used as shown in FIG. 6. In its longitudinal direction, the smaller barrier 11A has an overall length selected at between about 0.5 and 1.5 metres, preferably between about 0.8 to 1.3 metres, and most preferably between about 0.9 and 1.2 metres. The height and lateral width of the barrier 14 may vary, but is preferably selected at between about 0.5 and 4 metres, and most preferably about 1 to 1.85 metres. With the preferred size range, a smaller barrier 14 fully inflated with air would weight approximately 200 lbs.

In use, an uninflated barrier cover 8 is oriented in an outstretched position extending longitudinally parallel to the bank of a flooding river 13, so that its bottom or sole panel is resting substantially flat against the ground 12. Once in position outstretched and parallel to the bank of the flooding river 13, the front and rear aprons 1, 2 are extended towards or away from the flood water. The aprons 1, 2 may be anchored to the ground using sand bags, tent pegs or any other form of attachment.

A multitude of base posts 25 are located around the uninflated barrier cover 8, with one at each end, lined up with the end retaining tabs 4, and a base post 25 located where each rear support retaining tabs 5 line up. The base posts 25 are then secured to the ground by asphalt/concrete anchors or ground stakes. A support tube 21 is placed on top of each base post 25, with either the end retaining tabs or the rear support retaining tabs 5 encircling each support tube 21.

The inflatable crossbeams 7 are then inflated, starting with the inflatable crossbeam 7 closest to the ground. The crossbeams 7 can be either inflated to low or high pressure, depending on the situation and the type of crossbeam used. As the crossbeams 7 are inflated, and the barrier cover 8 is lifted higher, the end retaining tabs 4 and rear support retaining tabs 5 will slide higher up on the support tube 21. Once fully inflated, each end retaining tab 4 and rear support retaining tab 5 is then secured to the support tube 21 by a securing clamp 22.

Additional base posts 25 are positioned rearward of the barrier cover 8, and also secured to the ground. Preferably in a position where once the extendable support 24 is secured, it will be perpendicular to the barrier cover 8. Each additional base post 25 has an extendable support 24 extend between it and the support tube 21, and secured at each end by a securing clamp 22.

Where a barrier cover 8 is to be joined to another barrier, the end retaining tabs 4 from the adjacent ends of each barrier cover 8 are placed above or below those of its neighbouring panel, before the support tubes 21 are inserted. This provides not only the connection between the adjacent barriers, but also allows barriers to be joined at various different angles.

When it is required to remove the flood barrier 11, the securing clamps 22, the extendable supports 24, and the support tubes 21 are removed and the barrier cover 8 can be laid flat for cleaning and decontamination. After cleaning, the crossbeams are deflated and the barrier cover 8 can be rolled up for storage.

The scope of the claims should not be limited by the preferred embodiments set forth in the examples, but should be given the broadest interpretation consistent with the description as a whole.

What is claimed is:

1. A rapidly deployable flood defence system, comprising:

at least one barrier cover, each comprising:

a plurality of laterally-extending crossbeam housing tubes being stacked in a generally vertical direction, each crossbeam housing tube comprises:

an inflatable crossbeam disposed within the crossbeam housing tube;

an end retaining tab at each end of the crossbeam housing tube; and a plurality of rear support retaining tabs spaced along the lateral length of the crossbeam housing tube, where each of the rear support retaining tabs is generally in the same vertical plane as the rear support retaining tab on the crossbeam housing tube above or below; and a front apron and a rear apron, each at a base of the at least one barrier cover;

a plurality of support tubes extending in the generally vertical direction, with said plurality of support tubes including:

one support tube placed at each end of the crossbeam housing tubes and through the plurality of end retaining tabs to hold the support tube in place, and a plurality of additional support tubes positioned along the lateral length of the crossbeam housing tube and held in place by the plurality of rear support retaining tabs;

each of the plurality of support tubes is held in the generally vertical direction by a base post which is configured to be secured to the ground; and each of the additional support tubes positioned along the lateral length of the crossbeam housing tube comprises an additional base post positioned rearwardly from the additional support tube, and an extendable support which extends between the additional base post and the additional support tube.

2. The rapidly deployable flood defence system of claim 1, where the at least one barrier cover comprises a first barrier cover and a second barrier cover, and the one support tube placed through the plurality of end retaining tabs at one end of the first barrier cover is also placed through the plurality of end retaining tabs at one end of the second barrier cover forming a barrier cover connection.

3. The rapidly deployable flood defence system of claim 2, further comprising a laterally extending side cover panel at the end of the first barrier cover, covering the barrier cover connection.

4. The rapidly deployable flood defence system of claim 3, further comprising securing clamps securing each of the plurality of extendable supports to one of the plurality of support tubes.

5. The rapidly deployable flood defence system of claim 4, wherein each of the plurality of extendable supports has a variable length, allowing it to be secured by the securing clamps at a varying point in the generally vertical direction of the corresponding extendable support.

6. The rapidly deployable flood defence system of claim 5, further comprising securing clamps securing each of the plurality of rear support retaining tabs to each of the plurality of support tubes.

7. A method of deploying a flood defence system, comprising the steps of:

a) orienting a barrier cover laterally parallel to a bank of a flooding river, the barrier cover comprising a plurality of laterally-extending crossbeam housing tubes stacked in a generally vertical direction, with each crossbeam housing tube comprising an uninflated inflatable crossbeam disposed therein, an end retaining tab at each end of the crossbeam housing tube and a plurality of rear support retaining tabs spaced along the lateral length of the crossbeam housing tube, where each of the rear support retaining tabs is generally in the same vertical plane as the rear support retaining tab on the crossbeam housing tube above or below;

b) securing a base post to the ground at the position of each of the end retaining tabs and each of the plurality of rear support retaining tabs;

c) placing a support tube at each end of the crossbeam housing tube and at each of the plurality of rear support retaining tabs;

d) inserting each of the support tubes located at each end of the crossbeam housing tube through the end retaining tabs and on the base post in the generally vertical direction;

e) inserting each of the support tubes located at each of the plurality of rear support retaining tabs through the end retaining tabs and on the base post in the generally vertical direction;

f) for each of the support tubes located at each of the plurality of rear support retaining tabs, securing an additional base post in a rearward direction;

g) inflating the inflatable crossbeams; and h) extending an extendable support between each of the additional base posts and the corresponding support tube located at each of the plurality of rear support retaining tabs.

8. The method of deploying a flood defence system of claim 7, further comprising:

deploying a second barrier cover laterally adjacent to the barrier cover, where during step d), when the support tube is inserted at one end of the crossbeam housing tube through the end retaining tabs of the barrier cover, the support tube is also inserted through the end retaining tabs of the second barrier cover, forming a barrier cover connection.

9. The method of deploying a flood defence system of claim 8, comprising the additional step of covering the barrier cover connection with a side cover panel which extends laterally from the barrier cover.

10. The method of deploying a flood defence system of claim 9, comprising the additional step of securing each of the extendable supports to each of the corresponding support tubes with a securing clamp.

11. The method of deploying a flood defence system of claim 10, comprising the additional step of securing each of the plurality of rear support retaining tabs to each of the plurality of support tubes with a securing clamp.

12. The method of deploying a flood defence system of claim 11, comprising the additional steps of: extending a front apron and a rear apron from the barrier cover, and securing the front and rear aprons to the ground with sand bags or tent pegs.

13. The rapidly deployable flood defence system of claim 1, further comprising securing clamps securing each of the plurality of extendable supports to one of the plurality of support tubes.

14. The rapidly deployable flood defence system of claim 13, wherein each of the plurality of extendable supports has a variable length, allowing it to be secured by the securing clamps at a varying point in the generally vertical direction of the corresponding extendable support.

15. The rapidly deployable flood defence system of claim 1, further comprising securing clamps securing each of the plurality of rear support retaining tabs to each of the plurality of support tubes.

16. The method of deploying a flood defence system of claim 7, comprising the additional step of securing each of the extendable supports to each of the corresponding support tubes with a securing clamp.

17. The method of deploying a flood defence system of claim 7, comprising the additional step of securing each of the plurality of rear support retaining tabs to each of the plurality of support tubes with a securing clamp.

18. The method of deploying a flood defence system of claim 7, comprising the additional steps of: extending a front apron and a rear apron from the barrier cover, and securing the front and rear aprons to the ground with sand bags or tent pegs.

* * * * *